US008820237B2

(12) United States Patent
Koopmann

(10) Patent No.: US 8,820,237 B2
(45) Date of Patent: Sep. 2, 2014

(54) DEVICE AND METHOD FOR COUPLING A COLOR TRANSFER ROLLER

(75) Inventor: Dietmar Koopmann, Lienen (DE)

(73) Assignee: Windmoeller & Hoelscher KG, Lengerich (DE)

( * ) Notice: Subject to any disclaimer, the term of this patent is extended or adjusted under 35 U.S.C. 154(b) by 236 days.

(21) Appl. No.: 12/736,976

(22) PCT Filed: May 26, 2009

(86) PCT No.: PCT/EP2009/003725

§ 371 (c)(1),
(2), (4) Date: Nov. 29, 2010

(87) PCT Pub. No.: WO2009/146814

PCT Pub. Date: Dec. 10, 2009

(65) Prior Publication Data

US 2011/0088579 A1 Apr. 21, 2011

(30) Foreign Application Priority Data

May 29, 2008 (DE) ..... 10 2008 025 998

(51) Int. Cl.

| | |
|---|---|
| ***B41F 13/30*** | (2006.01) |
| ***B41F 31/30*** | (2006.01) |
| ***B41F 31/00*** | (2006.01) |
| ***B41F 31/36*** | (2006.01) |

(52) U.S. Cl.

CPC ..... *B41F 31/304* (2013.01); *B41F 31/004* (2013.01); *B41F 31/36* (2013.01); *B41P 2213/25* (2013.01)

USPC ..... 101/479; 101/216; 101/348

(58) Field of Classification Search

CPC ..... B41F 31/004; B41F 31/36; B41F 31/304; B41F 31/307; B41F 31/305; B41F 13/30; B41F 13/28; B41F 13/40; B41F 13/20; B41F 13/26; B41P 2213/25; B41P 2213/804; B41P 2213/80

USPC ..... 101/216, 248, 481, 486, 479, 348

See application file for complete search history.

(56) References Cited

U.S. PATENT DOCUMENTS

| | | | | |
|---|---|---|---|---|
| 2,581,455 | A * | 1/1952 | Stempel | 384/611 |
| 4,586,434 | A * | 5/1986 | Tokuno et al. | 101/178 |

(Continued)

FOREIGN PATENT DOCUMENTS

| | | | |
|---|---|---|---|
| DE | 44 42 575 | C1 | 2/1996 |
| DE | 101 19 666 | A1 | 10/2002 |

(Continued)

*Primary Examiner* — Matthew G Marini
*Assistant Examiner* — Leo T Hinze
(74) *Attorney, Agent, or Firm* — Jacobson Holman, PLLC.

(57) ABSTRACT

A coupling device facilitates coupling of an ink transfer roller in an inking unit or printing unit of a printing machine. The ink transfer roller includes at least a roller body to which an end pin is connected, with each end pin of the roller being mounted to rotate in a bearing housing of the inking unit or printing unit via at least one bearing. The end pins of the roller include couplings with which the roller can be coupled and fastened in the inking unit or printing unit, with at least one end pin of the roller being splined to a shaft piece of a drive. The coupling device includes an actuator, with which at least one end pin of the ink transfer roller can be positioned against the shaft piece of the drive.

11 Claims, 2 Drawing Sheets

(56) References Cited

U.S. PATENT DOCUMENTS

| | | | | | |
|---|---|---|---|---|---|
| 5,647,275 | A | | 7/1997 | Lupa et al. | |
| 5,647,673 | A | * | 7/1997 | Grundke et al. | 384/519 |
| 5,813,336 | A | * | 9/1998 | Guaraldi et al. | 101/218 |
| 5,894,796 | A | | 4/1999 | Gelinas | |
| 5,906,162 | A | | 5/1999 | Kolbe et al. | |
| 5,974,968 | A | * | 11/1999 | Achelpohl et al. | 101/247 |
| 6,038,972 | A | | 3/2000 | Delwiche et al. | |
| 6,142,073 | A | * | 11/2000 | Zeman et al. | 101/216 |
| 6,244,406 | B1 | | 6/2001 | Kolbe et al. | |
| 6,543,356 | B2 | * | 4/2003 | Gottling et al. | 101/248 |
| 6,543,357 | B2 | | 4/2003 | Schroeder | |

FOREIGN PATENT DOCUMENTS

| | | | |
|---|---|---|---|
| DE | 699 27 193 | T2 | 2/2006 |
| DE | 10 2005 024 502 | A1 | 11/2006 |
| DE | 10 2005 039 782 | A1 | 3/2007 |
| EP | 0 639 452 | A1 | 2/1995 |
| EP | 0 894 623 | A2 | 2/1999 |
| EP | 1 016 520 | A1 | 7/2000 |
| EP | 1 016 522 | B1 | 7/2000 |
| EP | 1 151 862 | B1 | 12/2007 |
| ES | 2 264 323 | | 12/2006 |
| GB | 2 158 774 | B | 11/1985 |

* cited by examiner

DEVICE AND METHOD FOR COUPLING A COLOR TRANSFER ROLLER

CROSS-REFERENCE TO RELATED APPLICATION

This is a U.S. national stage application of PCT/EP09/03725 filed May 26, 2009, and published in German.

BACKGROUND OF THE INVENTION

1. Field of Invention

The invention concerns a device and method for connection of an ink transfer roller in an inking or printing unit of a printing machine, the roller consisting of at least one roller body to which end pins are connected, each pin of the roller being mounted to rotate in a bearing housing of the inking or printing unit via at least one bearing, the ends of the roller including couplings with which the roller can be connected and fastened in the inking or printing unit and in which at least one end pin of the roller can be splined to a shaft piece of the drive.

2. Description of the Prior Art

During a job change on printing machines it is necessary to replace the ink transfer rollers to which the rollers carrying the printed image belong with other new rollers of the same function.

In printing machines of the prior art, especially in flexographic printing machines, the pin of the roller on the drive side is equipped with a gear, which engages in the drive sprocket of a drive after introduction of the roller into the printing machine. On the operator side the pin is equipped with a bushing, which is brought into contact with a drive unit of a side register device. The gear bushings are so-called change parts. These change parts must be mounted on the end pins before introduction of the roller and removed again from the pins (by hand) after removal of the roller.

The roller change and therefore order change on printing machines is very time-consuming because of the change parts on the roller pins.

Patent application EP 1 016 520 A1 shows a drive coupling for connection of a drive shaft of a roller drive to a replaceable roller of a printing machine. The roller pin includes a locking part which can be coupled via a clamping piece of the drive shaft that matches it. Matching here means that the angle position of the cylinder agrees with the angle position of the drive shaft.

A shortcoming in EP 1 016 520 A1 is that the coupling of the roller to the drive must occur by hand, which is irksome and time-consuming.

DE 44 42 575 C1 also discloses a device for coupling of an ink transfer roller in an inking or printing unit of a printing machine. It shows an actuator for splined connection of the ink transfer roller to a shaft piece of the drive. The actuator then forces a half-coupling against a second half-coupling of the ink transfer cylinder. The drive force for the cylinder is transferred from a gear to a hollow shaft. A selector shaft arranged non-rotatable but axially movable in the hollow shaft is arranged within the hollow shaft for coupling and uncoupling of the cylinder. The torque of the hollow shaft is transferred to the selector shaft in this way. The torque is transferred from there to the hollow cylinder via the two half-couplings.

This arrangement does not permit adjustment of the side register.

SUMMARY OF THE INVENTION

The task of the present invention is therefore to propose a device for connection of an ink transfer roller in an inking or printing unit of a printing machine, which reduces the drawbacks of the prior art.

This task is solved according to the invention by the features of the characterizing part of claims 1 and 9 described herein.

Owing to the fact that the coupling now no longer need occur by hand, it is possible, among other things, when the (new) rollers are to be introduced to the printing machine, for example, ink transfer rollers, to lift them by means of an appropriate automated device, for example, by means of a robot, to the corresponding coupling positions in a printing unit. Advantageous devices for transport of these rollers engage them on at least their end pins, while they transport the rollers between a bearing and the printing unit or inking unit. Generally these transport devices transfer the end pins to appropriate bearing sites in which the pins are mounted during printing operation.

The device according to the invention also permits adjustment of the side register of the ink transfer roller.

According to the invention it is proposed

- that the ink transfer roller include a half-coupling (4*a*, 6*a*) on both end pins (19),
- that the actuator (5, 13) be movable in the axial direction of the ink transfer roller, the half-couplings (4*a*, 6*a*) being shape-mated with corresponding half-couplings (4*b*, 6*b*) and
- that the actuator (5, 13) act against an axial bearing (7), which is movable in the axial direction (9, 10) of the ink transfer roller (22), the side register of the ink transfer roller being adjustable.

The splined connection can initially be press-fit or shape-mated. In a simple variant it consists of press-fitting of two flat shaft ends.

However, at least one end is advantageously provided with a half-coupling. A shaft pin held in the machine frame then carries the mating piece for this half-coupling.

The half-couplings advantageously produce shape-mating with each other.

The force that the actuator exerts on the couplings in the axial direction of the roller is chosen large enough in this case so that the couplings during printing operation of the printing machine engage in shape-mated fashion one in the other.

It is advantageous in this case that the force with which the actuator can be positioned against the couplings is constant or is kept constant. A compressed air cylinder is particularly suited as actuator for this purpose.

Shape-mated couplings consist of two shell halves, which are pressed or positioned against each other during coupling (the so-called coupling fit). The shape-mated coupling halves have the advantage that they have good "seating" relative to each other and therefore provide little "play."

It is particularly advantageous if the couplings situated on the end pins of the ink transfer roller are positive clutches. These positive clutches are a special form of shape-mated couplings in which two or more so-called extensions of the coupling halves mesh during coupling. This particular variant of a shape-mated coupling permits very high force transfer to the shafts connected to each other. The rollers can be acted upon with high speeds on this account.

It is advantageous if at least one half-coupling of the positive clutch has extensions that are raised into the plane of the end of the pin, i.e., engage over the remaining end of the pin.

It is also advantageous if the extensions of the positive clutch are beveled in their flanks. During any abrasion or wear of the extensions of the coupling halves they are "pushed further into each other" so that a shape-mated connection persists. This variant of the positive clutch offers particularly secure shape-mated connection free of play.

Coupling halves corresponding to the coupling halves on the pins of the roller are advantageously situated on the drive and operator side in the printing unit. The coupling halves of the pin of the roller are positioned on the corresponding coupling halves of the printing unit in the actual direction of the roller.

The force that the actuator exerts on the couplings in the axial direction can'vary with the printing speed of the machine. At lower printing speeds a lower force can be exerted on the couplings by the actuator than at higher speeds.

It is particularly advantageous that the device for coupling of an ink transfer roller in inking unit or printing unit includes a drive for side register adjustment of the format roller.

The side register adjustment is then advantageously situated on the drive side in the vicinity of an axial coupling of the roller.

It is also advantageous that the force that the drive furnishes for side register adjustment of the format roller acts either in the same direction as the force of the actuator or in the opposite direction of the force of the actuator.

Further practical examples of the invention are apparent from the description and claims.

BRIEF DESCRIPTION OF THE DRAWINGS

In the individual figures:

Figure 1A:
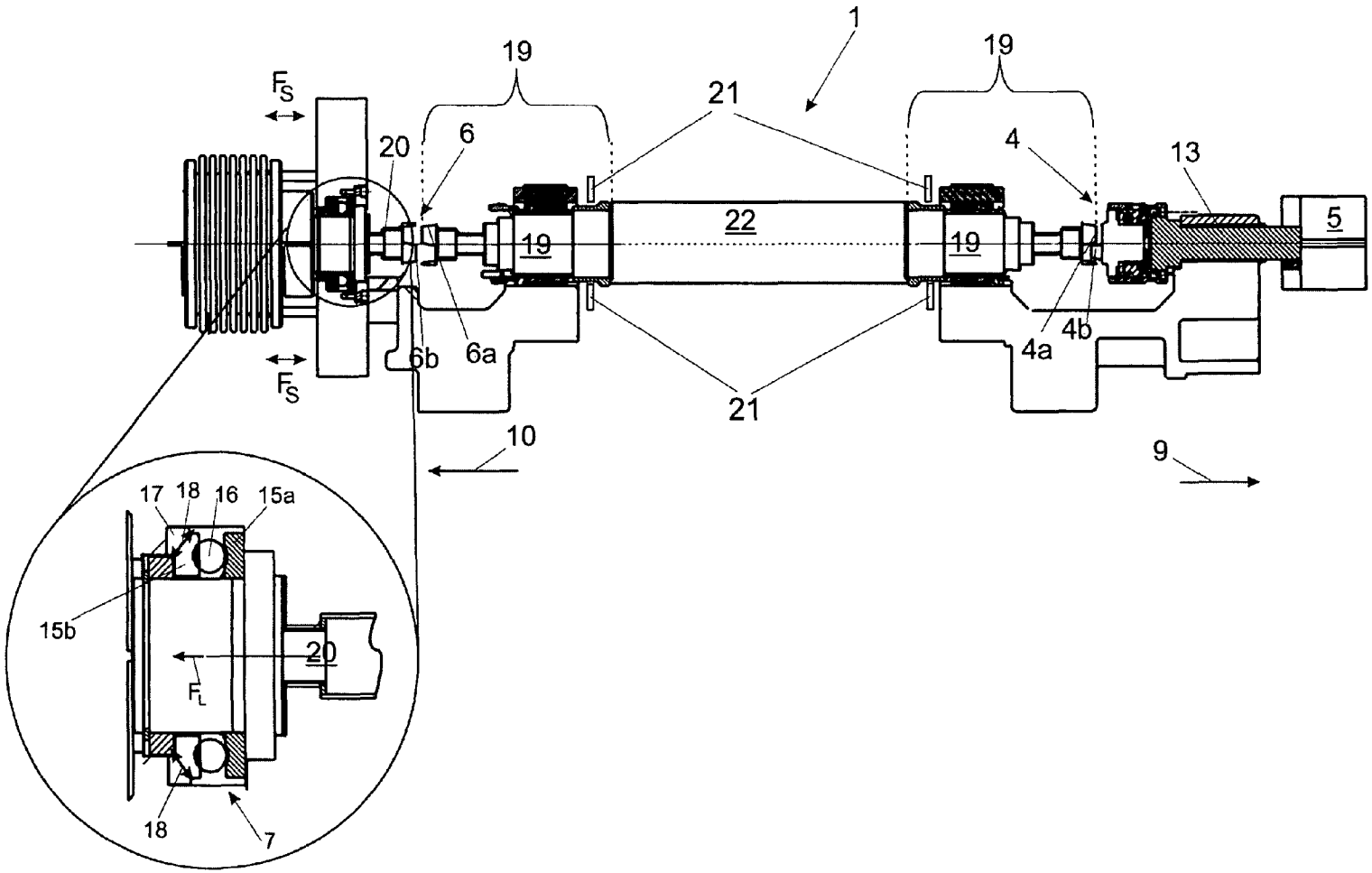
Figure 1B:
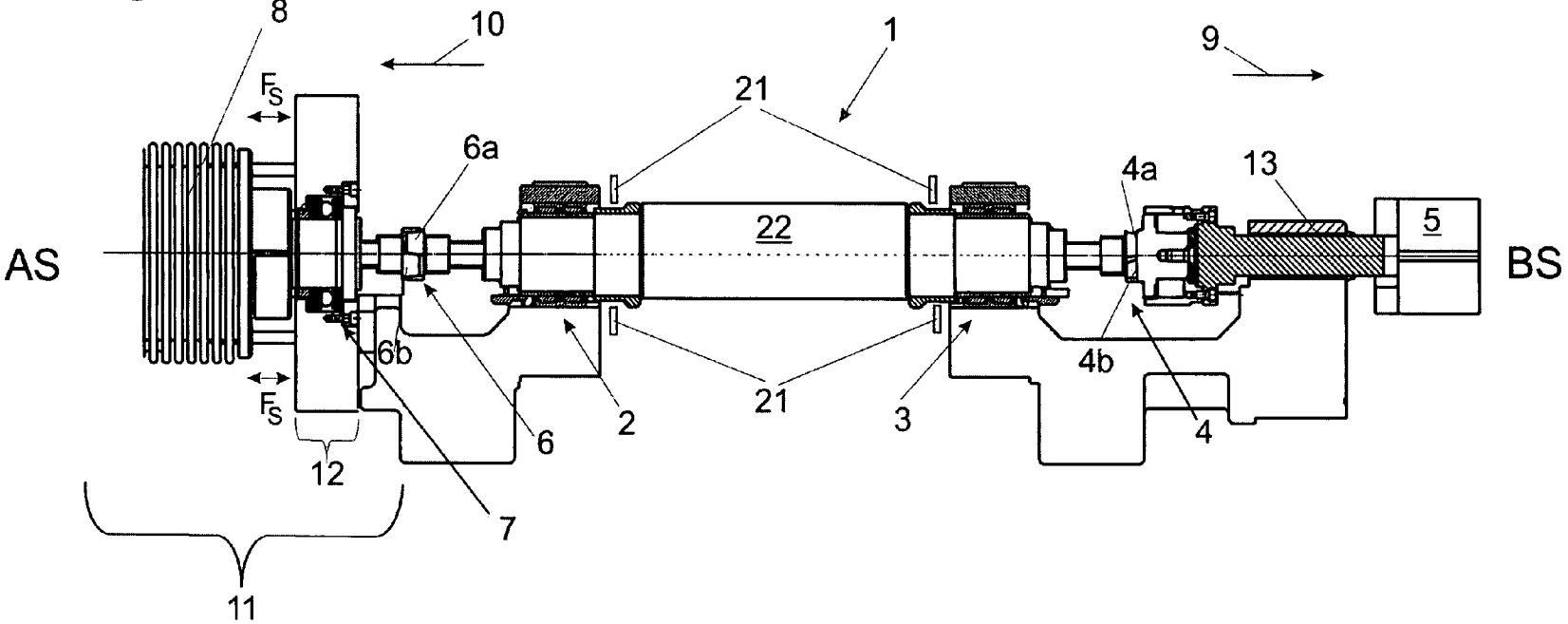

| | |
|---|---|
| FIG. 1a | shows a top view of a two-sided bearing of an ink transfer roller or ink transfer cylinder in the uncoupled state |
| FIG. 1b | shows a top view of a two-sided bearing of an ink transfer roller or ink transfer cylinder in the coupled state. |

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIGS. 1*a* and 1*b* show a top view of the two-sided variant with ink transfer roller or an ink transfer cylinder.

The ink transfer cylinder 1 to be changed is lifted and introduced into an inking or printing unit of a printing machine not shown in the drawing, for example, flexographic printing machine. Generally this procedure is conducted by means of gripping tools 21 that are shown in FIG. 1*b*.

The ink transfer cylinder 1 (for example, the format cylinder of a flexographic print machine) is mounted between the operator BS and drive side AS in a radial bearing 2 and 3.

The end shaft pins 19 of the ink transfer roller 1 include shape-mated coupling halves 4*a* and 6*a*. On the operator side BS the piston 13 of a compressed air piston cylinder unit 5, 13 includes on the end a half-coupling 4*b* corresponding to half-coupling 4*a*. On the drive side AS an additional half-coupling 6*b*, which corresponds to half-coupling 6*a*, is provided.

After the ink transfer roller 1 has been introduced into the printing unit by means of a device not shown in the inking or printing unit, the piston 13 of the compressed air cylinder piston unit 5, 13 is moved against the direction of arrow 9 and the half-couplings 6*a*, 6*b* and 4*a*, 4*b* are therefore connected in shape-mated fashion. The force that the compressed air cylinder piston unit 5, 13 exerts on the couplings 4, 6 is constant and chosen large enough so that shape-mating of the couplings 4 and 6 is also guaranteed during printing operation. The force can be varied, depending on the printing speed.

An axial bearing 7 is situated on the drive side AS, which is designed so that it compensates for an oblique position of the format cylinder, for example, caused by a different thickness of the printing block jacket over the printing width.

The axial bearing 7 is therefore advantageously an axial groove ball bearing whose bearing shells 15*a*, 15*b* can be moved relative to each other via balls 16. An oblique position of the format cylinder 1 (a so-called angle error) can be compensated by movement of the bearing shell 15*b* along arrow 18 on a so-called ring 17.

A shaft bellows 8, for example, a metal shaft bellows is situated behind the axial bearing 7, which can compensate for axial offset that the oblique position of the format cylinder 1 transfers to the axial bearing 7.

The shaft bellows 8 is connected to the drive unit. The drive exerts a torque on the ink transfer cylinder 1 via the shaft bellows 8. The shaft bellows in the present case is naturally designed so that it can transfer a torque and tolerate the angle offset.

Because of the property that the shaft bellows is compressible or stretchable in the axial direction, the side register of the ink transfer cylinder 1 can be adjusted by the piston 13 of the compressed air piston cylinder unit 5, 13.

Another advantage of the shaft bellows 8 is that it has high torsional rigidity.

During an order or format change the piston of the compressed air cylinder 5 is moved in the direction of arrow 9 and the positive half-coupling 4*b* released from the half-coupling 4*a* of cylinder 1. At the same time (with a device not shown in FIGS. 1*a*, 1*b*) the drive area 11 is moved in the direction of arrow 10 and the half-couplings 6*a*, 6*b* of the positive clutch 6 are therefore separated from each other. The ink transfer cylinder 1 (with a device not shown in FIG. 1) can now be removed from the printing machine, for example, lifted out.

In order to adjust the side register in the printing machine the area 12 that includes the axial bearing 7 can be moved in the direction of arrows 9 and 10 by means of a spindle adjustment not shown here. The force $F_S$ applied by the spindle adjustment to the side register is symbolized by the arrow $F_S$. The force required for side registry advantageously engages on a bearing retaining bushing. During the side registry process a number of components, which naturally also include the ink transfer cylinder 1 in addition to the axial bearing, are also moved. On the operating side BS the compressed air cylinder body 5 remains fixed on the frame, while its piston 13 is moved.

Because of the compressibility and stretchability of the shaft bellows 8 the motor (not shown) can remain fixed during the side registry movement.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference numbers | |
|---|---|
| 1 | Ink transfer cylinder |
| 2 | Radial bearing of the ink transfer cylinder |
| 3 | Radial bearing of the ink transfer cylinder |
| 4 | Coupling/positive clutch/half-couplings 4a and 4b |
| 5 | Compressed air cylinder |
| 6 | (Second) coupling/positive clutch/half-couplings 6a and 6b |
| 7 | Axial bearing/groove ball bearing |
| 8 | (Metal) shaft bellows |
| 9 | Arrow |
| 10 | Arrow |
| 11 | Drive area |
| 12 | Axial bearing area |
| 13 | Piston of the compressed air cylinder body 5 |
| 14 | Movable bearing block |
| 15 | Bearing shells 15a, 15b of bearing 7 |
| 16 | Ball of bearing 7 |
| 17 | Ring of bearing 7 |
| 18 | Arrow |
| 19 | End pin |
| 20 | Shaft piece of the drive |
| 21 | Gripper |
| 22 | Roller body |
| BS | Operator side |
| AS | Drive side |
| $F_S$ | Force for side registry |

What is claimed is:

1. A device for connection of an ink transfer roller in an inking unit or printing unit of a printing machine, the ink transfer roller having at least a roller body to which an end pin is connected at each end thereof, each end pin of the ink transfer roller being mounted to rotate in a bearing housing of the inking unit or printing unit in at least one hearing, in which at least one end pin of the ink transfer roller is splined to a shaft piece of a drive, said device comprising:

an actuator located on a non-drive side of the device to effect a splined connection of the ink transfer roller to the shaft piece of the drive, with which the at least one end pin of the ink transfer roller is positioned against the shaft piece of the drive, the ink transfer roller including a half-coupling on both end pins thereof, and the half-couplings of the ink transfer end pins being shape-mated with corresponding half-couplings on the shaft piece of the drive and on the actuator;

an axial bearing located on a drive-side of the device, the axial bearing being movable in an axial direction of the ink transfer roller; and a shaft bellows located between the drive and the axial bearing, the bellows being configured to compensate for axial offset transferred from the ink transfer roller to the axial bearing, the actuator being movable in the axial direction of the ink transfer roller so as to (i) effect the splined connection of the ink transfer roller to the shaft piece of the drive and (ii) enable an adjustment of a side register of the ink transfer roller by acting against the movable axial bearing.

2. The device according to claim 1, wherein the actuator is a compressed air cylinder.

3. The device according to claim 1, wherein at least one half-coupling, which is situated on the at least one end pin of the ink transfer roller, is a half-coupling of a positive clutch.

4. The device according to claim 3, wherein the at least one half-coupling of the positive clutch has extensions that are raised in a plane of an end of the end pin.

5. The device according to claim 4, wherein flanks of the extensions are beveled.

6. The device according to claim 1, further comprising a drive for the side register adjustment of the ink transfer roller, wherein a force that the drive provides for the side register adjustment of the ink transfer roller acts either in a same direction as the force of the actuator or in a direction opposite to that of the force of the actuator.

7. A method for transfer of an ink transfer roller to an inking unit or printing unit of a printing machine and for coupling of the transferred ink transfer roller to a drive of the inking unit or printing unit, said method comprising:

introducing to the inking unit or printing unit an ink transfer roller, which includes a roller body to which at least one end pin is connected;

grasping with a gripping mechanism of a transport device, before the transfer to the inking unit or printing unit, the at least one end pin and mounting the ink transfer roller to rotate after transfer by at least one hearing; and making a splined connection of the at least one end pin of the ink transfer roller to a shaft piece of the drive, the splined connection being made with an actuator located on a non-drive-side of the device, which positions the at least one end pin of the ink transfer roller against the shaft piece of the drive, the ink transfer roller including a half-coupling on both end pins thereof, and the half-couplings of the ink transfer roller end pins being shape-mated with corresponding half-couplings on the shaft piece of the drive and on the actuator, an axial bearing located on a drive-side of the device, the axial bearing being movable in an axial direction of the ink transfer roller, the actuator being movable in the axial direction of the ink transfer roller so as to (i) effect the splined connection of the ink transfer roller to the shaft piece of the drive and (ii) enable an adjustment of a side register of the ink transfer roller by acting against the movable axial bearing.

8. The method according to claim 7, wherein a force with which the actuator carries out the splined connection is kept constant.

9. The method. according to claim 7, wherein a force with which the actuator carries out the splined connection is aligned exclusively axially.

10. The method according to claim 7, wherein a force with which the actuator carries out splined connection varies with a printing speed of the machine.

11. The method according to claim 7, wherein a shaft bellows is located between the drive and the axial bearing, the bellows compensating for axial offset transferred from the ink transfer roller to the axial bearing.

* * * * *